US007370699B2

(12) United States Patent
Adam et al.

(10) Patent No.: US 7,370,699 B2
(45) Date of Patent: May 13, 2008

(54) ONE TRIP CEMENTED EXPANDABLE MONOBORE LINER SYSTEM AND METHOD

(75) Inventors: Mark K. Adam, Houston, TX (US); Michael A. Carmody, Houston, TX (US); Mathew J. Jabs, Houston, TX (US); Robert S. O'Brien, Katy, TX (US); Dennis G. Jiral, Katy, TX (US); Harold E. Payne, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/349,014

(22) Filed: Feb. 7, 2006

(65) Prior Publication Data

US 2006/0272827 A1 Dec. 7, 2006

Related U.S. Application Data

(60) Provisional application No. 60/652,374, filed on Feb. 11, 2005.

(51) Int. Cl.
*E21B 43/10* (2006.01)

(52) U.S. Cl. ..... 166/207; 166/384

(58) Field of Classification Search ..... 166/384, 166/386, 207, 332.1, 177.4
See application file for complete search history.

(56) References Cited

U.S. PATENT DOCUMENTS 6,029,748 A * 2/2000 Forsyth et al. ..... 166/380

(Continued)

FOREIGN PATENT DOCUMENTS

WO WO 2004/072436 A1 8/2004

*Primary Examiner*—Jennifer H. Gay
*Assistant Examiner*—Daniel P Stephenson
(74) *Attorney, Agent, or Firm*—Steve Rosenblatt

(57) ABSTRACT

An apparatus to protect the mounting area of casing and a locating profile and optionally a sliding sleeve valve and a flow path from the outside of the valve to the annulus when subsequent attachment of an expanded liner is intended and the expanded liner is to be cemented in place. A barrier sleeve, nose, and outer sleeve define a sealed cavity having a loose incompressible material inside that covers the mounting location on the casing. A locating profile and an optional sliding sleeve valve and a flow path from the outside of the valve to the annulus can be provided. The cementing of the casing takes place through the barrier sleeve. After the cementing, the sleeve and nose are drilled out and the incompressible material is removed to the surface with the drill cuttings. A liner is inserted in the casing and is preferably expanded into sealing contact with the mounting location on the casing. After expansion a cement retainer positioned at the bottom of the expanded liner and the sliding sleeve located either above the mounting location of the liner in the casing shoe or in the liner below the mounted top section allow cement to be delivered outside the expanded liner and the displaced wellbore fluid to return into the casing through so that the liner can be cemented. The cement retainer can be delivered with either the liner or the expansion tools to allow expansion and cementing in a single trip. A shifting tool can be run on the expansion string to actuate the sliding sleeve and if necessary to allow for cement to be pumped from the drill string into the annulus through the sliding sleeve. The cement retainer can be milled out in a separate trip.

6 Claims, 20 Drawing Sheets

U.S. PATENT DOCUMENTS 6,098,717 A * 8/2000 Bailey et al. ..... 166/382
6,446,724 B2 9/2002 Baugh et al.
6,561,271 B2 5/2003 Baugh et al.
6,598,677 B1 7/2003 Baugh et al.
6,631,765 B2 10/2003 Baugh et al.
6,725,917 B2 * 4/2004 Metcalfe ..... 166/153
6,799,635 B2 * 10/2004 Schultz et al. ..... 166/285
6,843,322 B2 * 1/2005 Burtner et al. ..... 166/382
6,915,852 B2 7/2005 Baugh et al.
7,204,007 B2 * 4/2007 Cook et al. ..... 29/507
7,240,739 B2 7/2007 Schoonderbeek et al.
2003/0188868 A1 10/2003 Simpson et al.
2004/0045718 A1 3/2004 Brisco et al.
2004/0251034 A1 12/2004 Kendziora et al.
2005/0098324 A1 5/2005 Gano
2005/0217866 A1 10/2005 Watson et al.
2005/0236163 A1 10/2005 Cook et al.
2006/0027370 A1 * 2/2006 Weinrich ..... 166/313
2006/0225892 A1 10/2006 Watson et al.

* cited by examiner

ONE TRIP CEMENTED EXPANDABLE MONOBORE LINER SYSTEM AND METHOD

PRIORITY INFORMATION

This application claims the benefit of U.S. Provisional Application No. 60/652,374, filed on Feb. 11, 2005.

FIELD OF THE INVENTION

The field of this invention is the method of running a tubular inside casing and securing it and more particularly to techniques for protecting the mounting location for the tubular on the casing as the casing is cemented and thereafter cementing the liner after it is expanded into the mounting location.

BACKGROUND OF THE INVENTION

FIG. 1 is illustrative of the prior techniques of running in casing with a casing shoe 16 near its lower end. If later a tubular is run in and needs to be attached to the casing by expansion, the presence of cement debris in the support area on the casing where the tubular will be attached could prevent a sealed connection from being obtained. One way around that would be to deliver the cement into a shoe mounted below the point at which the liner will be attached later. Another method would be to run brushes and scrapers into the mounting location after cementing to be sure it was clean so that a good seal and support for the tubular subsequently installed can be obtained. However these techniques require significant amounts of time and create an associated cost.

The present invention protects the mounting location on the casing during cementing with a barrier sleeve that covers a recess. The barrier sleeve defines a sealed annular space that contains an incompressible material. This allows the barrier sleeve to be compliant to changes in hydrostatic pressure as the casing is lowered into place. Cementing is done through the barrier sleeve. The barrier sleeve is subsequently drilled out exposing a recess and a locating profile and optionally a sliding sleeve valve. The tubular can then be positioned accurately using the locating profile and a collet mechanism on the expansion tool and expanded in to sealing contact with the casing. Due to the recess, the drift diameter of the tubular after expansion into the recess is at least as large as the casing drift diameter. The entire tubular can be expanded to its lower end and a run in shoe at the lower end of the tubular can be retrieved and removed from the well with the swaging assembly and the running string that delivered it. The sliding sleeve in the casing shoe can be selectively opened and closed with a shifting tool run on the expansion string above the expansion tools, running tool, and the liner to be expanded. Another option is for this sliding sleeve to be located in the liner to be expanded below the upper portion that mounts in the above casing. The port opened and closed by this sliding sleeve can be used to either pump cement into the annulus or to return the wellbore fluid displaced by cement from the annulus into the casing string. When the sliding sleeve is in the casing shoe, to allow for fluid flow between the outside of this port and the annulus below the shoe after the shoe has been cemented with the string to which it is attached an additional outer sleeve is run on the outside of the recess sleeve. This outer sleeve is connected at its lower end to the inner barrier sleeve via a guide nose. The flow path between the outside of the ports and the annulus is opened when the nose is drilled out and under reamed. A cement retainer device is to be located at the bottom of the string preventing cement pumped into the annulus from entering into the expanded liner due to density differences. This retainer device can be the location from which cement is pumped into the annulus or where the wellbore fluid displaced by the cement is returned from the annulus to the inside of the casing string. The cement retainer can be drilled out in a subsequent trip into the hole. These advantages and others of the present invention will be readily appreciated by those skilled in the art from a review of the description of the preferred embodiment and the claims that appear below.

SUMMARY OF THE INVENTION

An apparatus to protect the mounting area of casing and a locating profile and optionally a sliding sleeve valve and a flow path from the outside of the valve to the annulus when subsequent attachment of an expanded liner is intended and the expanded liner is to be cemented in place. A barrier sleeve, nose, and outer sleeve define a sealed cavity having a loose incompressible material inside that covers the mounting location on the casing. A locating profile and an optional sliding sleeve valve and a flow path from the outside of the valve to the annulus can be provided. The cementing of the casing takes place through the barrier sleeve. After the cementing, the sleeve and nose are drilled out and the incompressible material is removed to the surface with the drill cuttings. A liner is inserted in the casing and is preferably expanded into sealing contact with the mounting location on the casing. After expansion a cement retainer positioned at the bottom of the expanded liner and the sliding sleeve located either above the mounting location of the liner in the casing shoe or in the liner below the mounted top section allow cement to be delivered outside the expanded liner and the displaced wellbore fluid to return into the casing through so that the liner can be cemented. The cement retainer can be delivered with either the liner or the expansion tools to allow expansion and cementing in a single trip. A shifting tool can be run on the expansion string to actuate the sliding sleeve and if necessary to allow for cement to be pumped from the drill string into the annulus through the sliding sleeve. The cement retainer can be milled out in a separate trip.

DETAILED DESCRIPTION OF THE DRAWINGS

Figure 16A:
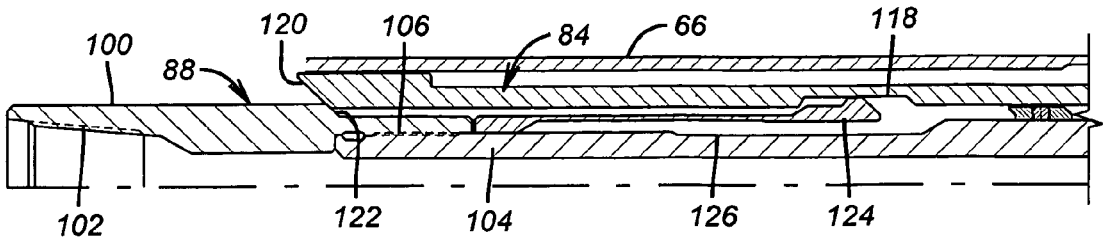
Figure 17A:
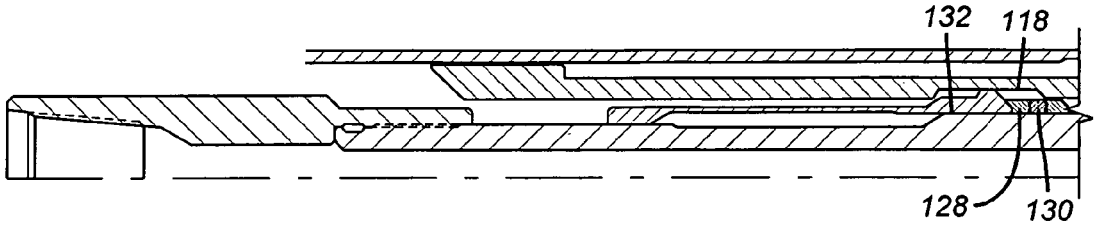
Figure 18A:
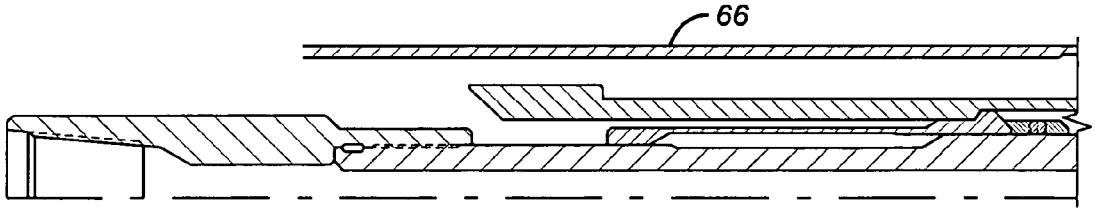
Figure 19A:
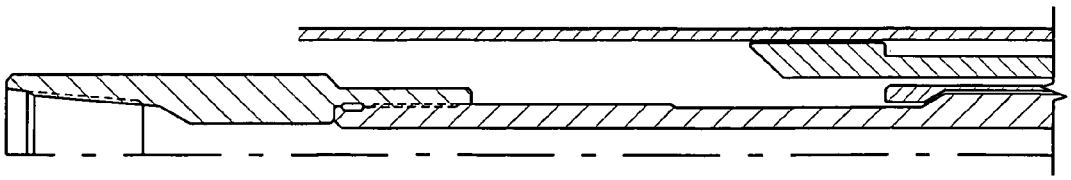
Figure 16B:
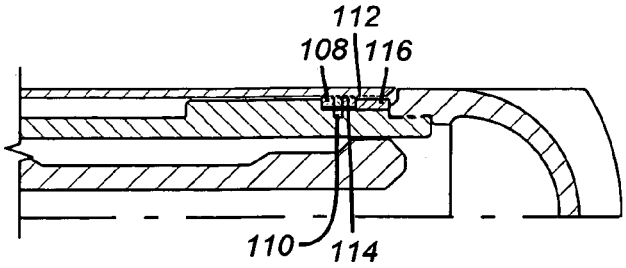
Figure 17B:
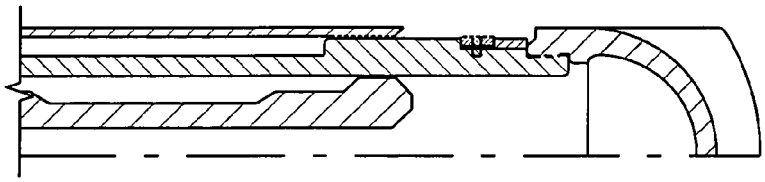
Figure 18B:
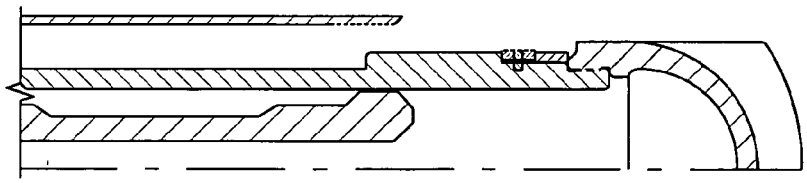
Figure 19B:
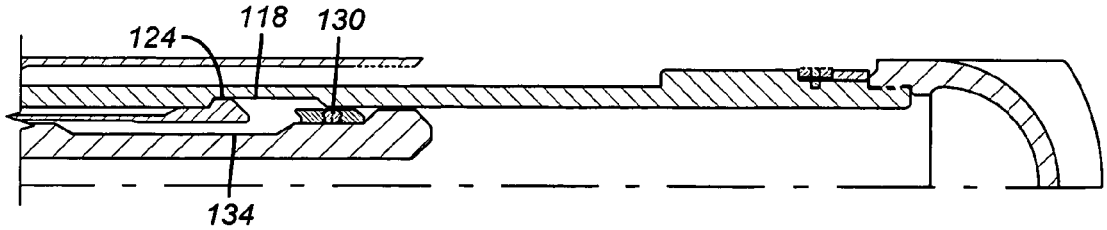
Figure 20:
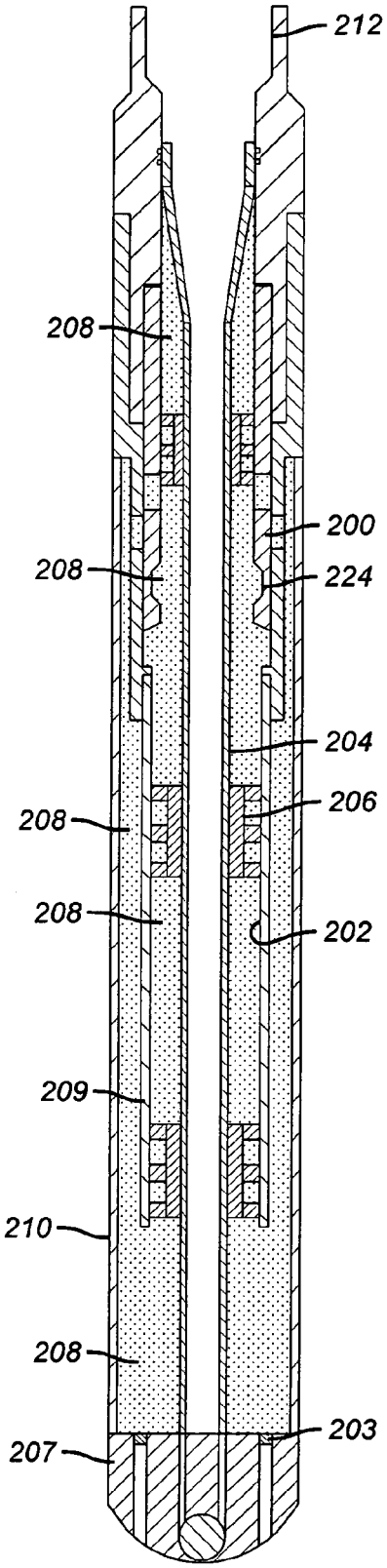
Figure 21A:
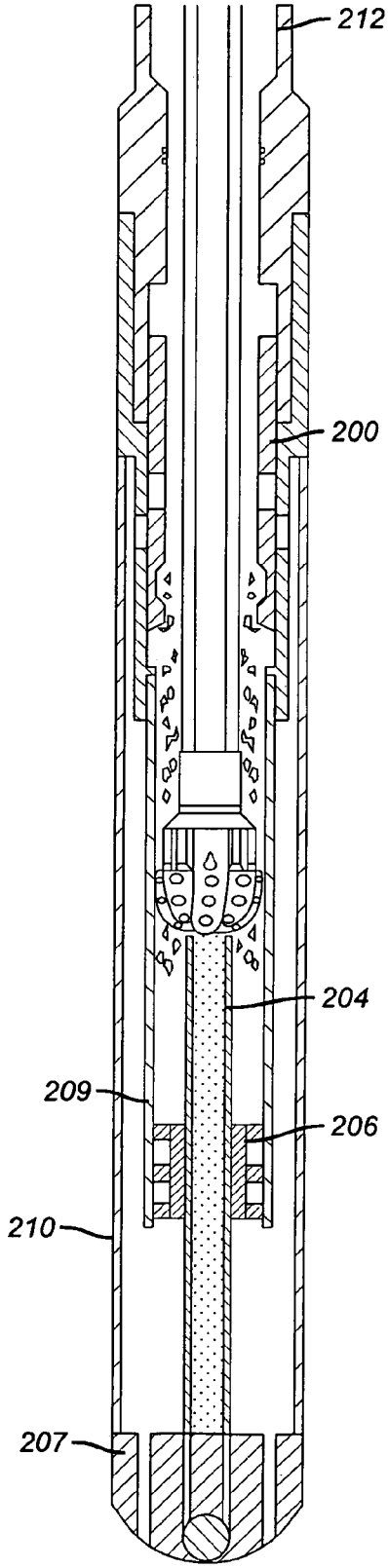
Figure 21B:
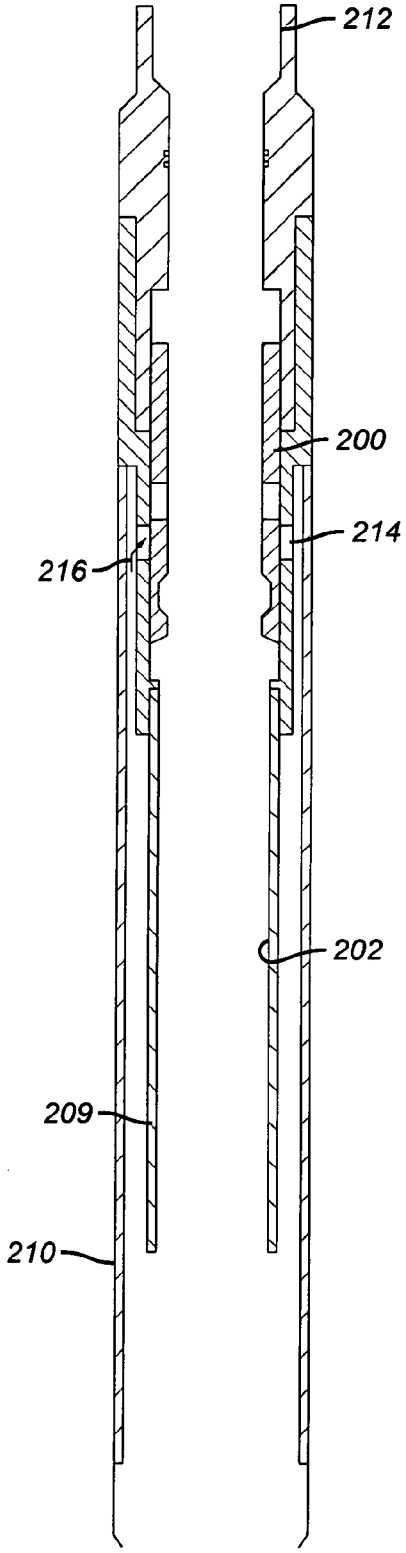
Figure 22:
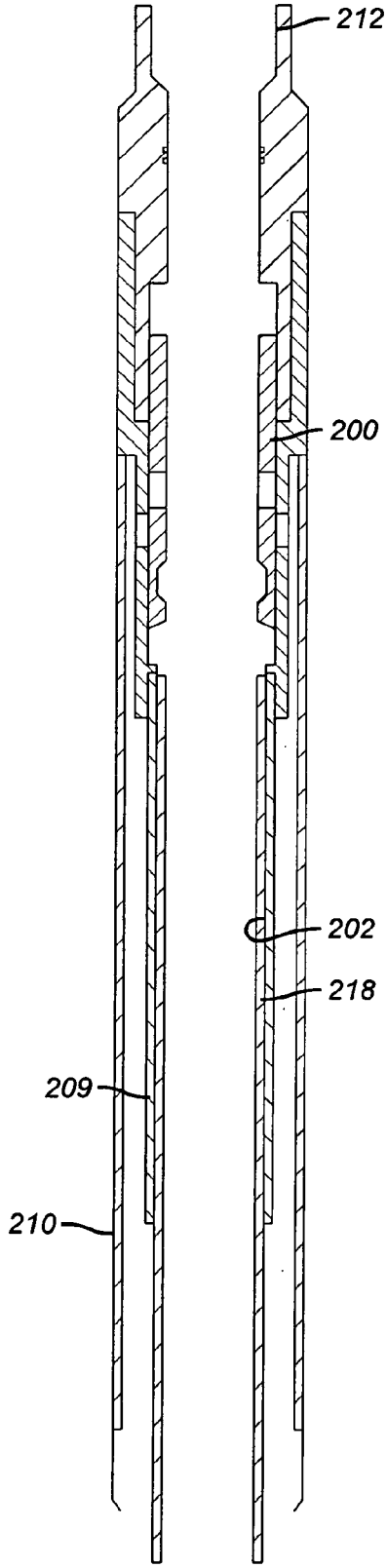
Figure 23:
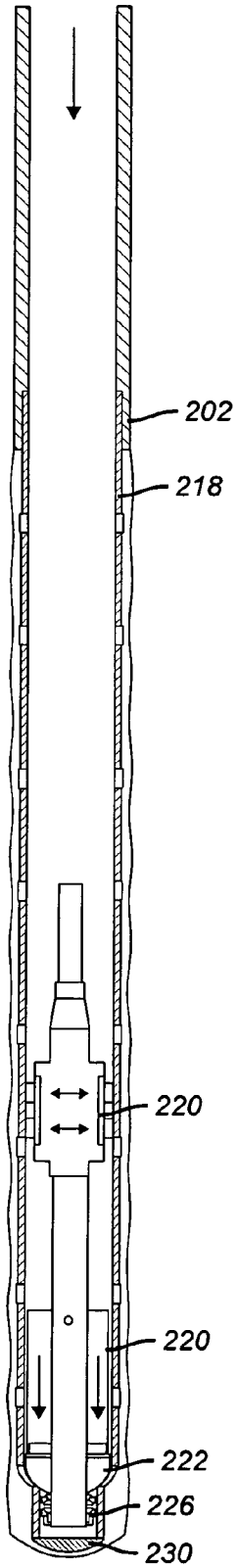
Figure 24:
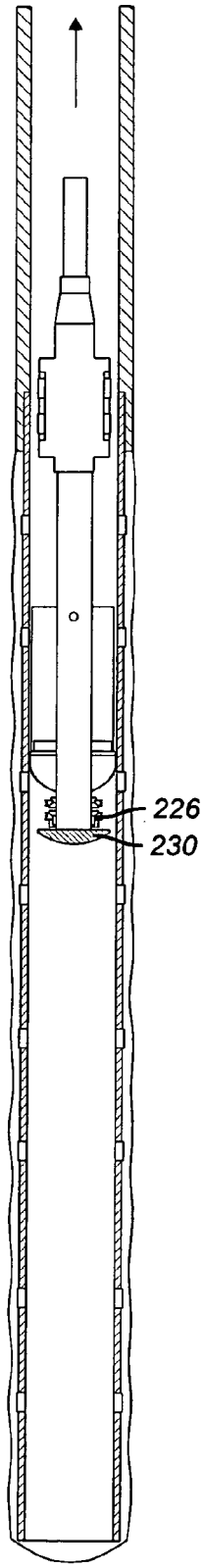
Figure 25:
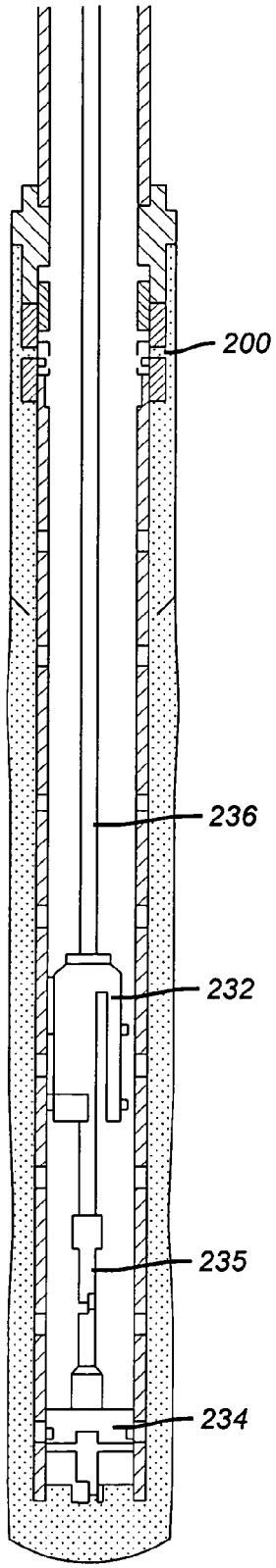
Figure 26:
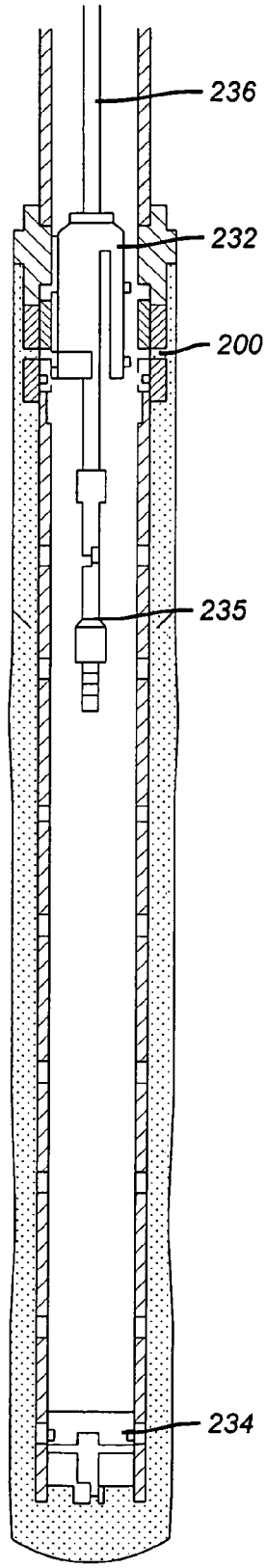
Figure 27:
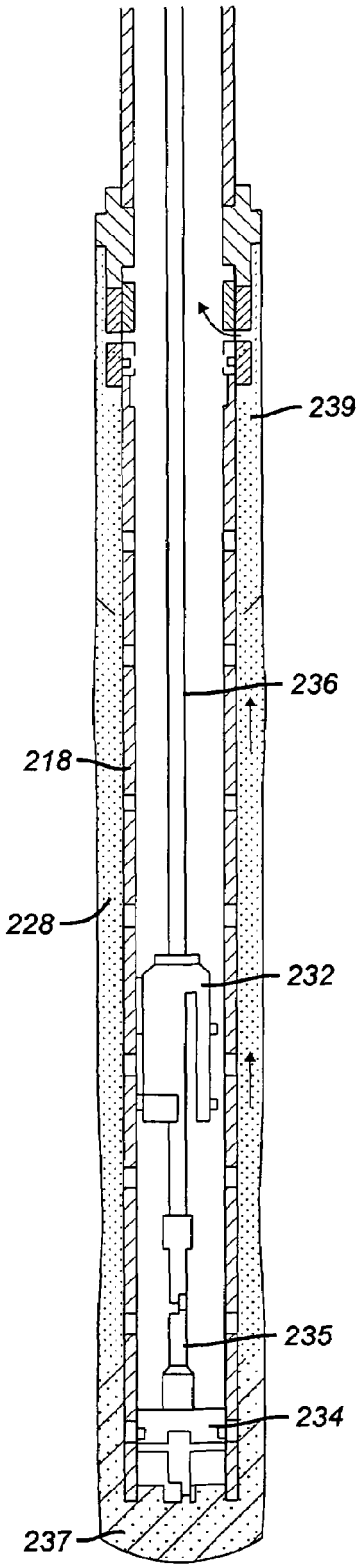
Figure 28:
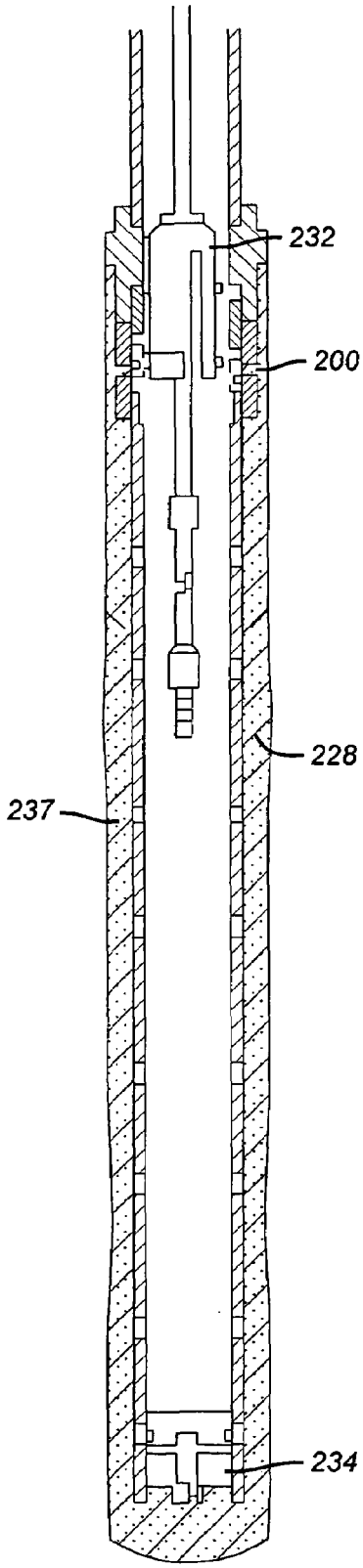
Figure 29:
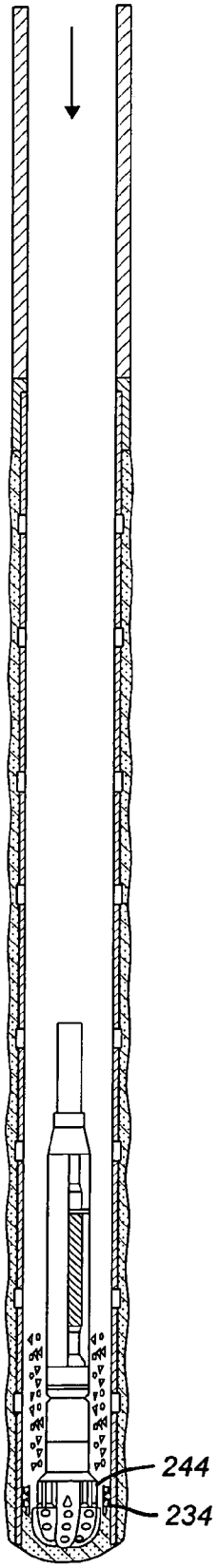
Figure 30:
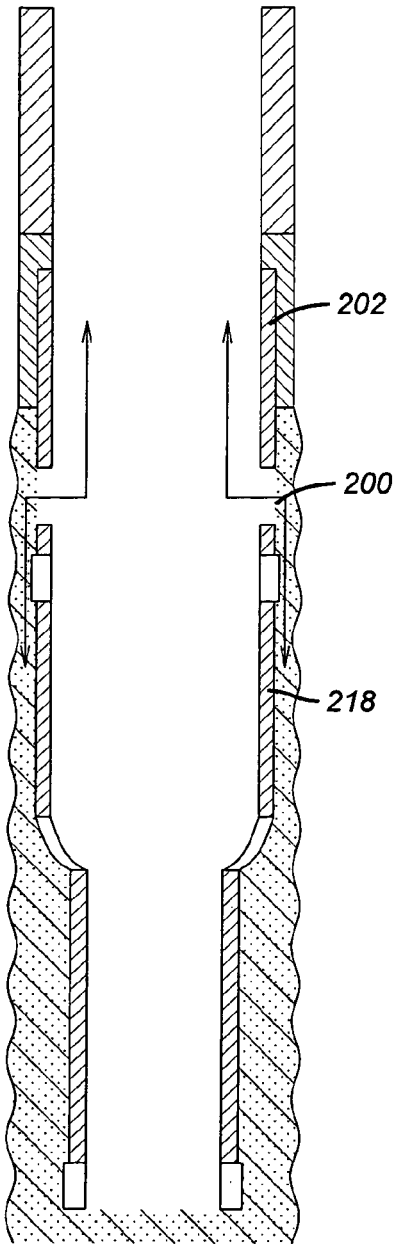
Figure 31:
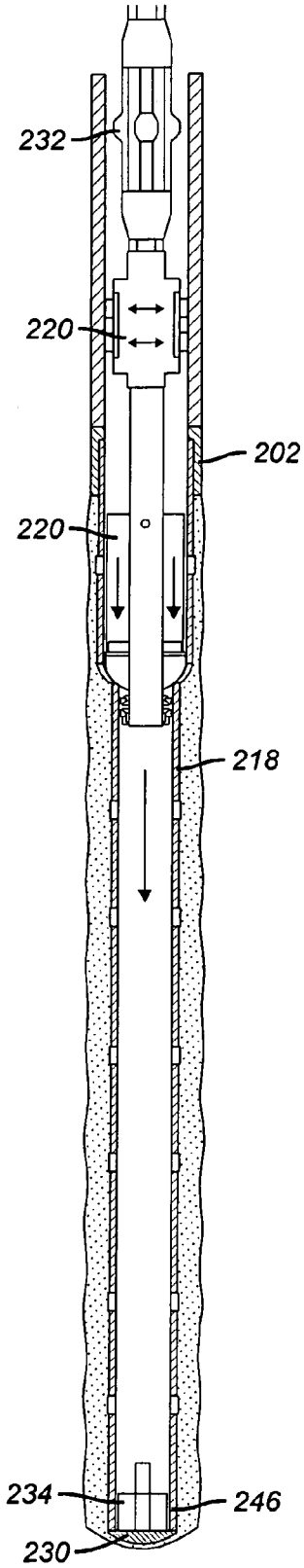
Figure 32:
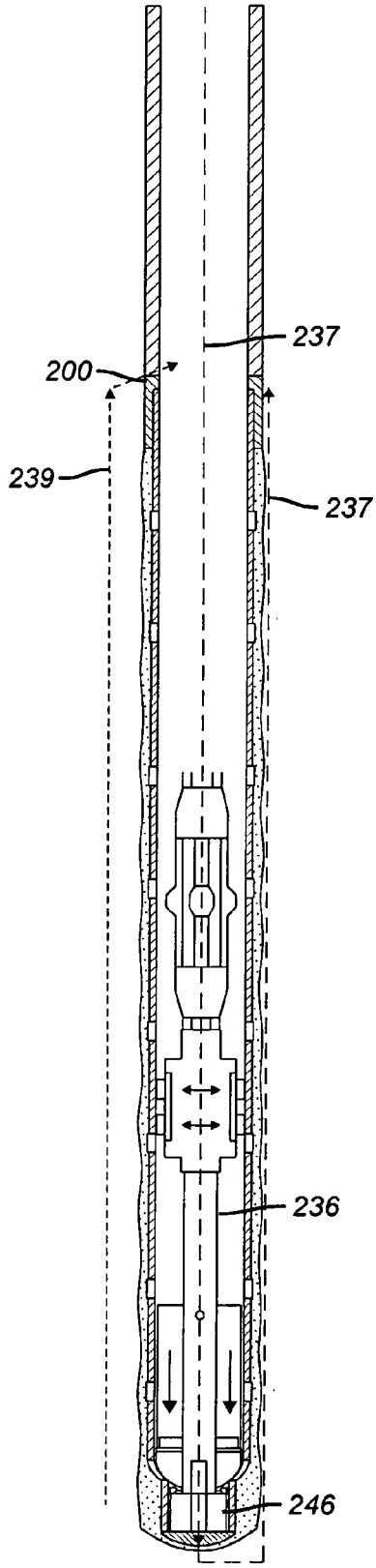
Figure 33:
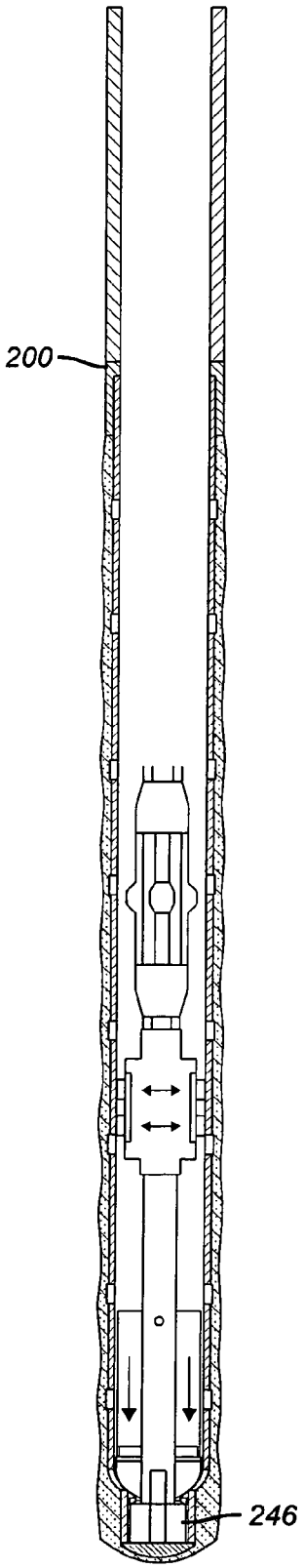
Figure 34:
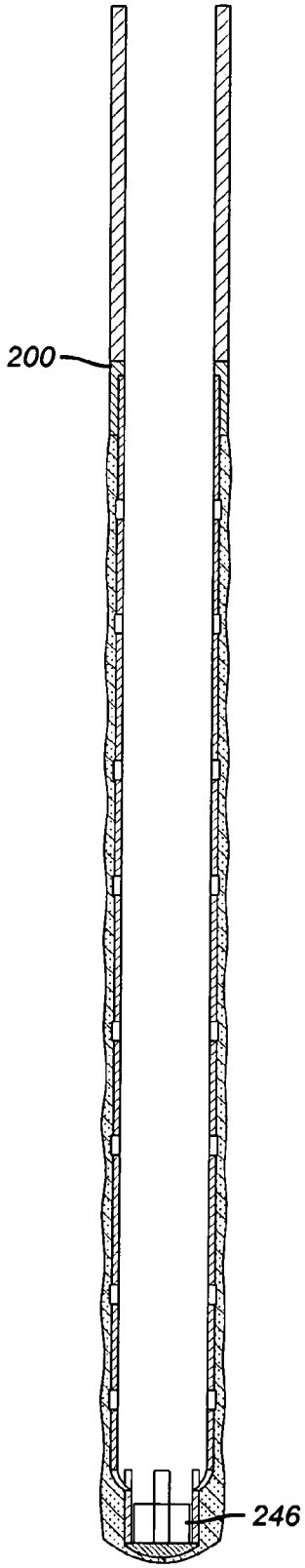
Figure 35:
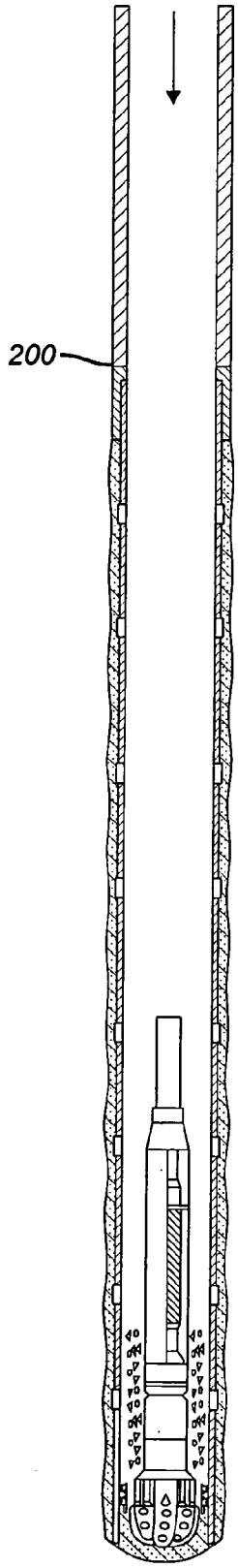
Figure 36:
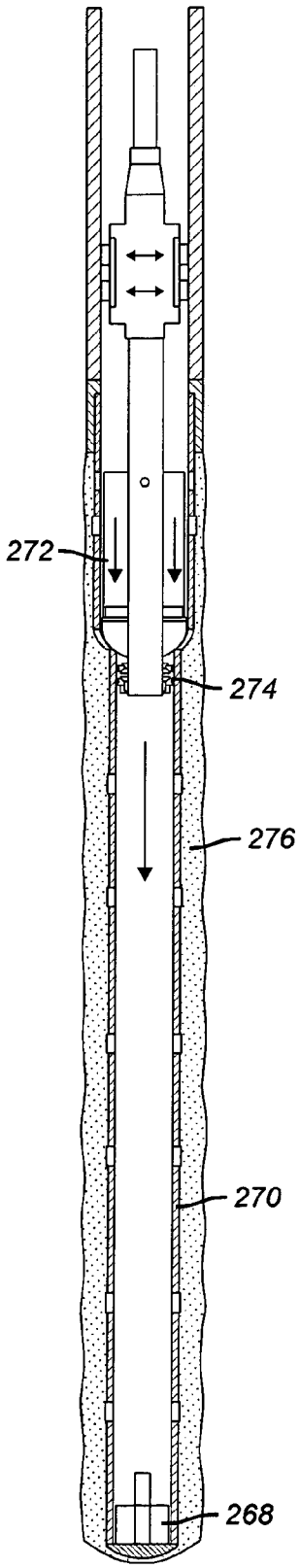
Figure 37:
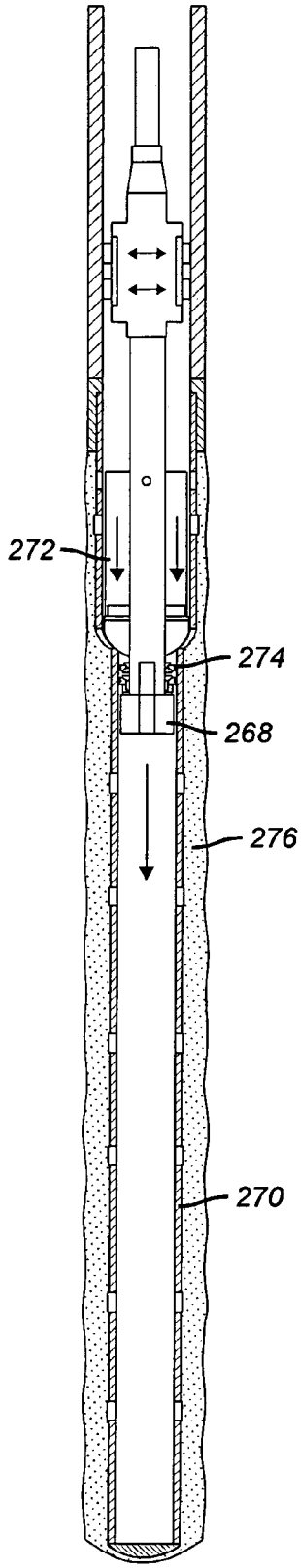
Figure 38:
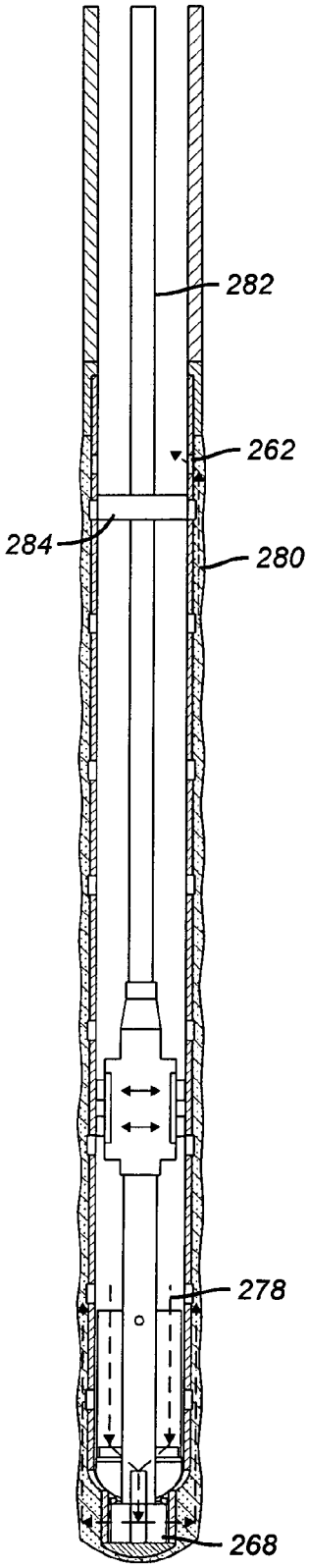
Figure 39:
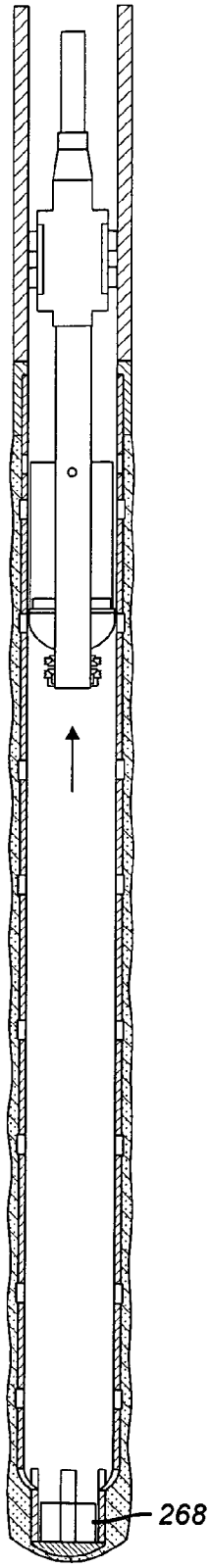
Figure 40:
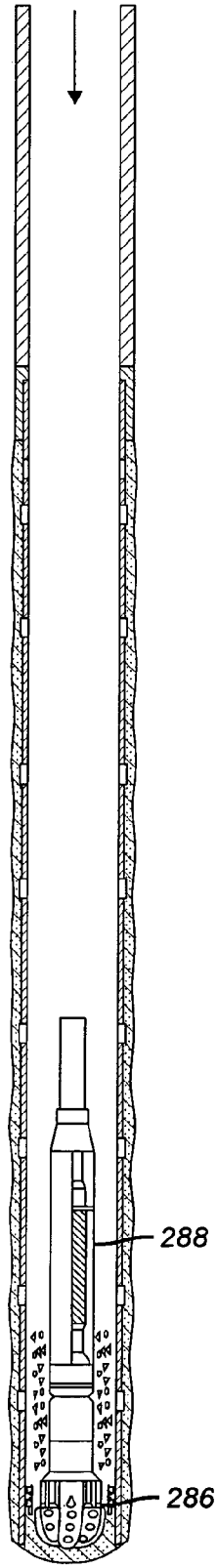
Figure 41:
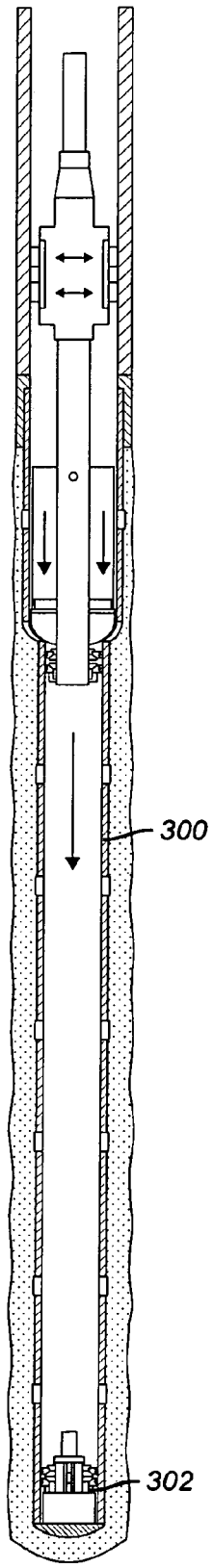
Figure 42:
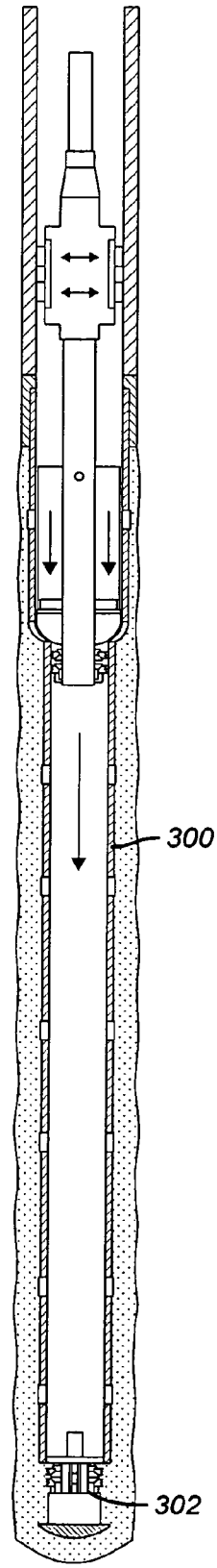
Figure 43:
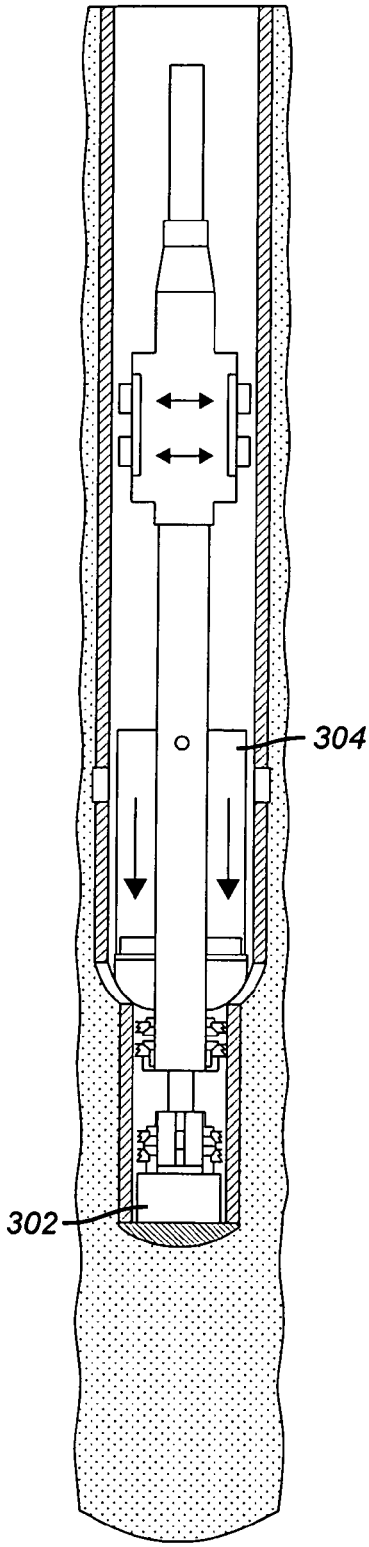
Figure 44:
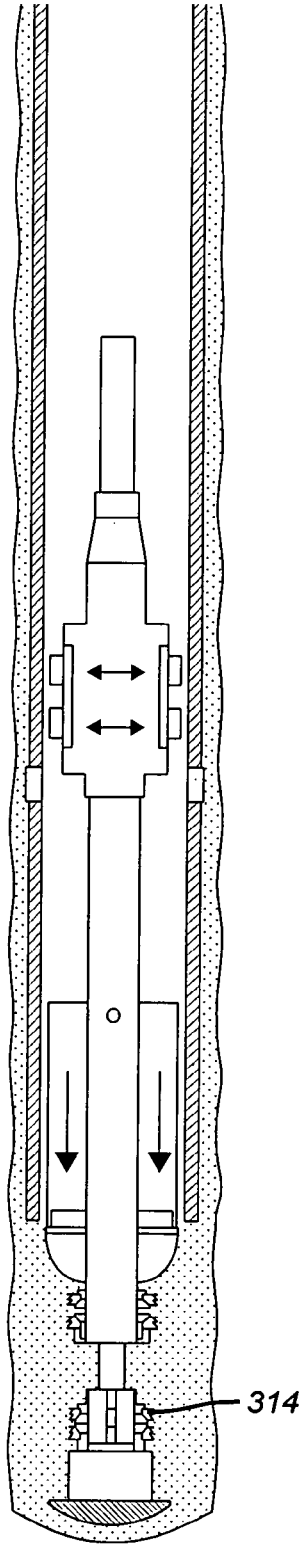
Figure 45:
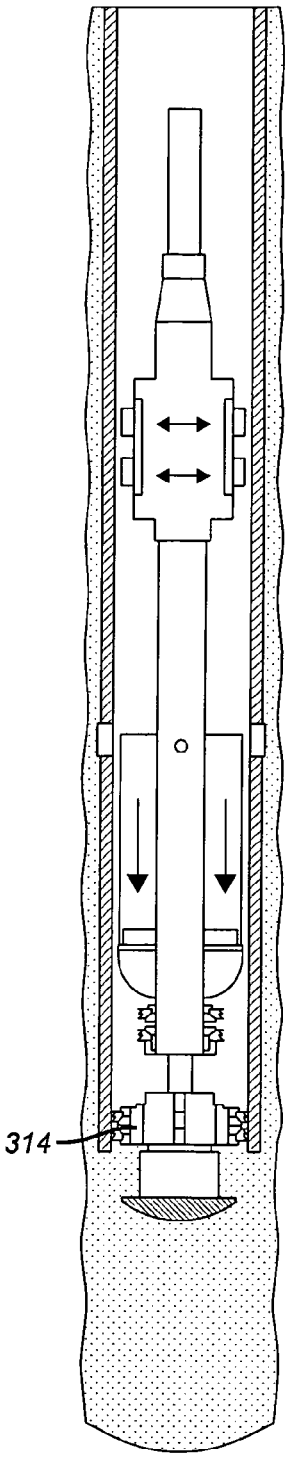
Figure 46:
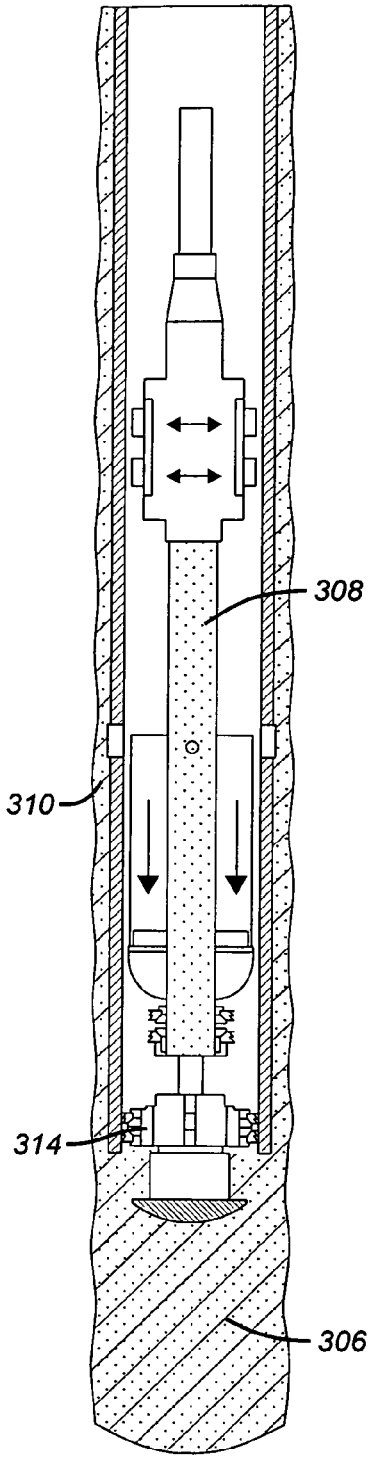
Figure 47:
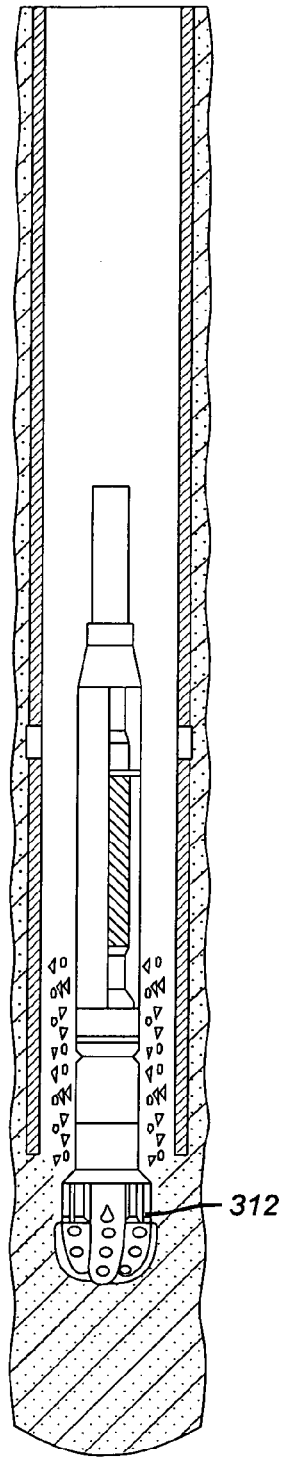

FIGS. 16*a*-16*b* show the capture of the guide nose assembly;

FIGS. 17*a*-17*b* show the shearing out of the guide nose assembly from the tubular or liner;

FIGS. 18*a*-18*b* show the guide nose fully released and captured;

FIGS. 19*a*-19*b* show the emergency release feature;

FIG. 20 shows a casing shoe in its run in configuration with locating profile, sliding sleeve valve closed over a port, recessed expanded liner mounting location, barrier sleeve, guide nose and outer sleeve;

FIG. 21A is a view of the casing shoe in FIG. 20 as it is being drilled and under reamed with the valve closed;

FIG. 21B is a view of the casing shoe in FIG. 20 after it has been drilled and under reamed with the valve closed;

FIG. 22 shows a liner expanded in place;

FIG. 23 shows expansion of a liner with a swage;

FIG. 24 is the view of FIG. 23 showing the removal of the swage and guide nose;

FIG. 25 shows a separate run to insert the cement retainer for cementing;

FIG. 26 is the view of FIG. 25 showing the cement retainer set in place and disengaged by its running tool, while the shifting tool is opening the sliding sleeve valve;

FIG. 27 shows cement being pumped into the annulus through the drill string and cement retainer and the displaced wellbore fluid being returned through the sliding sleeve valve into the casing;

FIG. 28 shows the sliding sleeve valve being shut by the shifting tool as the drill string is pulled from the well;

FIG. 29 shows a drill string milling away the cement retainer before it continues on to drill the next section;

FIG. 30 shows a closable aperture for use in cementing located in the portion of the liner to be expanded;

FIG. 31 shows a cementing shoe delivered with the liner before expansion and the swage initiates expansion;

FIG. 32 shows the expansion of FIG. 31 complete and the cementing shoe tagged into by the bottom hole assembly;

FIG. 33 is the view of FIG. 32 with cement delivered down the string and through the cementing shoe;

FIG. 34 is the view of FIG. 33 after cementing and removal of the bottom hole assembly leaving the cementing shoe in place;

FIG. 35 is the view of FIG. 34 showing the cementing shoe being milled out;

FIG. 36 shows an alternative to FIG. 31 delivering the cement retainer at the bottom of the swage assembly used for expanding;

FIG. 37 is an alternative to FIG. 36 where the shoe is delivered with the swage assembly;

FIG. 38 shows cementing by delivering into the top of the annulus of the expanded liner and taking well fluid returns through the shoe;

FIG. 39 shows removal of the swage assembly from the shoe after the cement is delivered to hold the cement in place;

FIG. 40 shows the shoe being drilled or milled out after the cementing is concluded;

FIG. 41 show an expandable tubular run in with a cementing isolation device near the lower end of the string and inside it;

FIG. 42 is the view of FIG. 41 with the cementing isolation device outside the tubular;

FIG. 43 shows the expansion nearly complete;

FIG. 44 shows the expansion system engaging the isolation device and moving down to conclude the expansion;

FIG. 45 shows the cementing device repositioned in the tubular and ready for cementing;

FIG. 46 shows cementing through the expansion assembly and the cementing device; and FIG. 47 shows the cementing device milled out after cementing.

DETAILED DESCRIPTION OF THE PREFERRED EMBODIMENT

Figure 1:
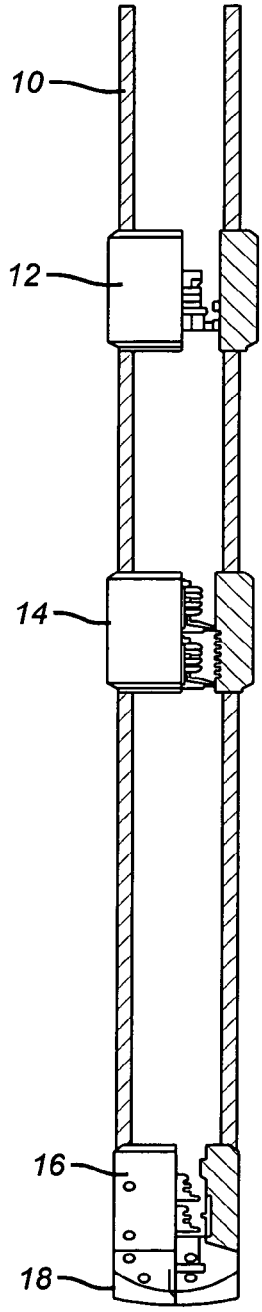
(PRIOR ART) FIG. 1
FIG. 1 is a prior art production casing illustrating a standard casing shoe at the lower end.

FIG. 1 illustrates a casing string 10 having a known landing collar 12 and a standard float collar 14 as well as a casing shoe 16 adjacent its lower end 18. Typically, in the past, the cement is pumped through the casing shoe 16 and then a dart or wiper is used to displace cement from the casing 10 and out through the shoe 16 and into the surrounding annulus. When the well is to be drilled deeper, the shoe 16 is drilled out but residual cement could still be present. The presence of such cement or shoe debris after drilling can affect the seal that is subsequently needed when a liner is inserted and secured to the casing 10. This is particularly a concern when the liner is to be expanded to secure it to a recessed mounting location at the bottom of the casing 10.

Figure 2:
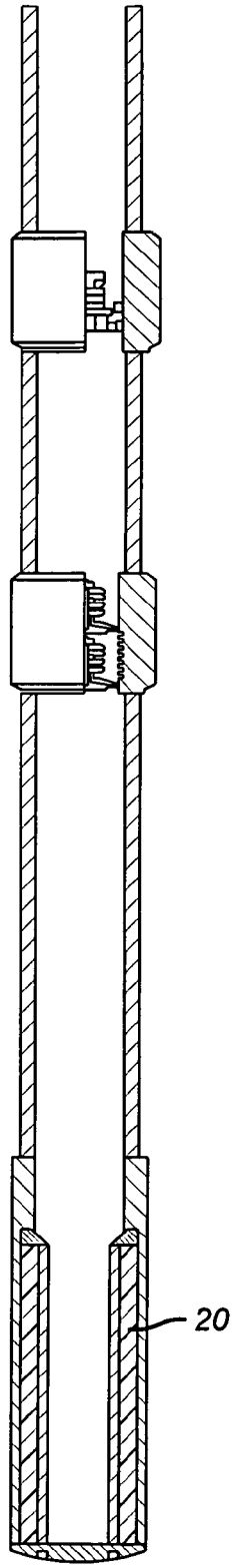
FIG. 2 shows a production string with the shoe track of the present invention.
Figure 15:
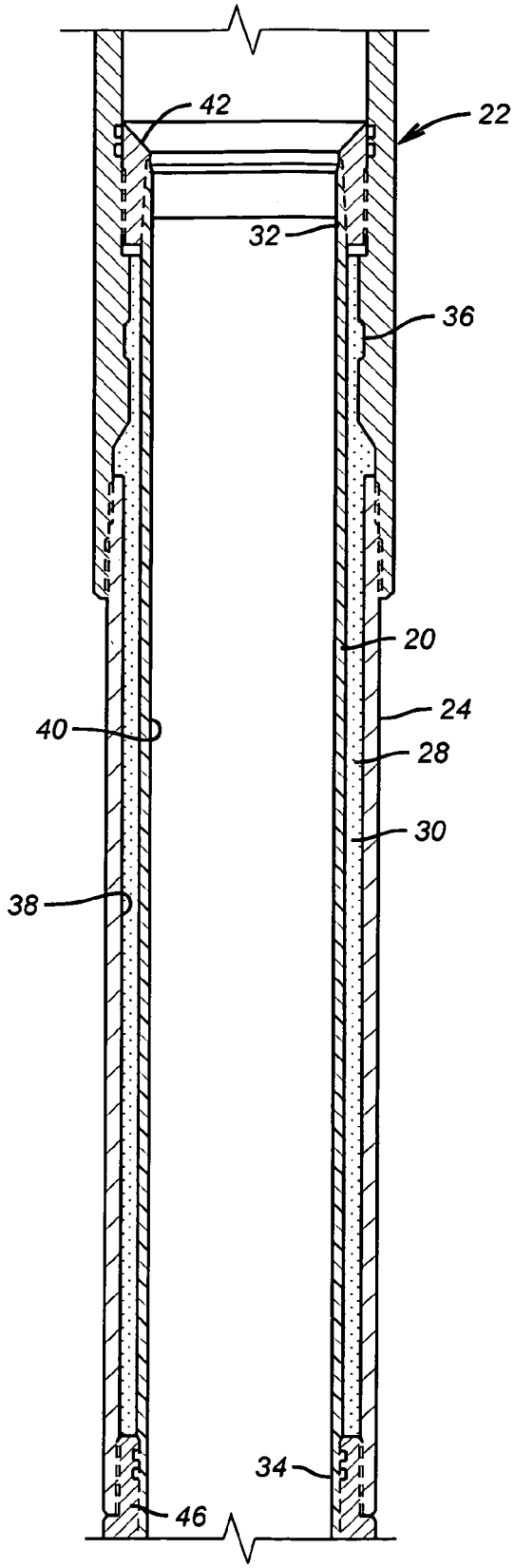
FIG. 15 is a close up view of the sleeve protecting the recessed shoe during cementing.

The present invention addresses this concern with a barrier sleeve 20 shown in FIGS. 2 and 15. As shown in FIG. 15, the casing string 22 has a lower section 24. Inside section 24 is a barrier sleeve 20 mounted and defining an annular space 28 that contains an incompressible material 30. Preferably the incompressible material 30 is loosely mounted sand but other materials can be used. The purpose of the material 30 is to control the burst of barrier sleeve 20 and the collapse of recessed mounting location 24 in response to increasing hydrostatic pressures as the depth of the casing 22 increases, when it is lowered into initial position. Sleeve 20 is preferably fiberglass sealed at ends 32 and 34. Sleeve 20 initially covers locating profile 36 and recessed mounting location 38, which will later serve as the location for securing a tubular such as a liner by a variety of methods. The preferred method of expansion will be described in more detail below. Sleeve 20 is preferably a material that can be quickly drilled such as plastics or composites, to mention a few. During cementing of the casing 22, the sleeve 20 has an inner surface 40, which is contacted by the cement. Ultimately a dart or wiper plug 42 passes through casing 22 and lands on landing collar 12 (see FIGS. 3 & 4) to displace most of the cement out of the casing 22 and into the surrounding annulus. The sleeve 20 is subsequently drilled out allowing the incompressible material 30 to escape and exposing the clean locating profile 36 and recessed mounting location 38 for subsequent attachment of a tubular as will be described below. The drilling removes all of seal rings 42 and 46 without damaging the casing 22 or recess sleeve 24.

Figure 3:
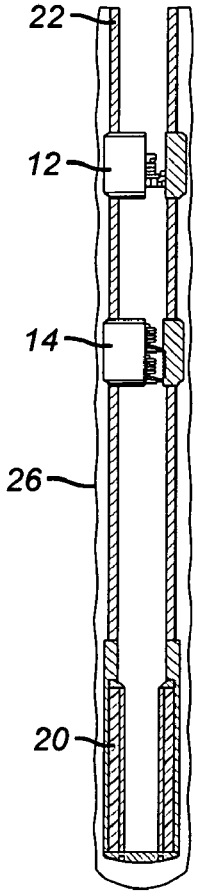
FIG. 3 shows the production casing with the shoe track of the present invention run into the wellbore.

The method can be understood by beginning at FIG. 3, where the casing 22 is mounted in the desired position for cementing in the wellbore 26. The assembly includes landing collar 12 and float collar 14. The assembly shown in FIG. 15 is at the lower end of the assembly, but for clarity only the barrier sleeve 20 is referenced in the schematic illustration.

Figure 4:
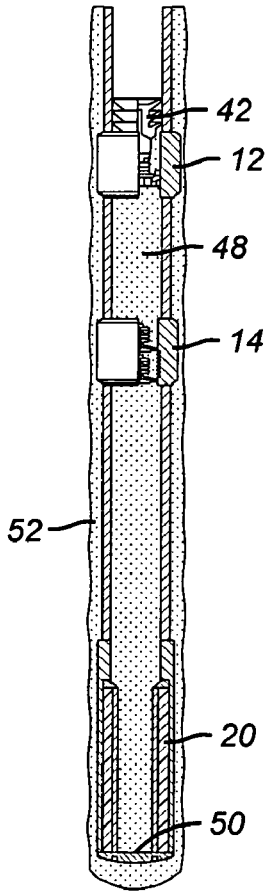
FIG. 4 is the view of FIG. 3, after cementing.

FIG. 4 shows that cement 48 has been displaced by plug 42 landing on landing collar 12. As a result, cement 48 is pushed through sleeve 20, through run in shoe 50 and into annulus 52.

Figure 5:
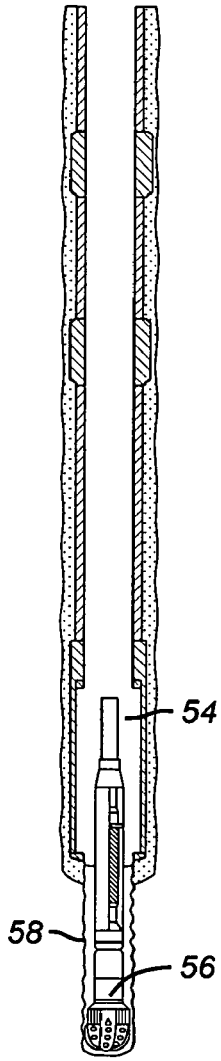
FIG. 5 is the view of FIG. 4 showing the shoe track exposed after drillout and the wellbore extended below the production casing.

In FIG. 5, a drill string 54 with a bit assembly 56 has been advanced through the casing 22 and has milled out the wiper 42 and the sleeve 20 to expose locating recess 36 and long recess 38. The incompressible material 30 is released and circulated to the surface with the drill cuttings from the action of bit assembly 56.

Figure 6:
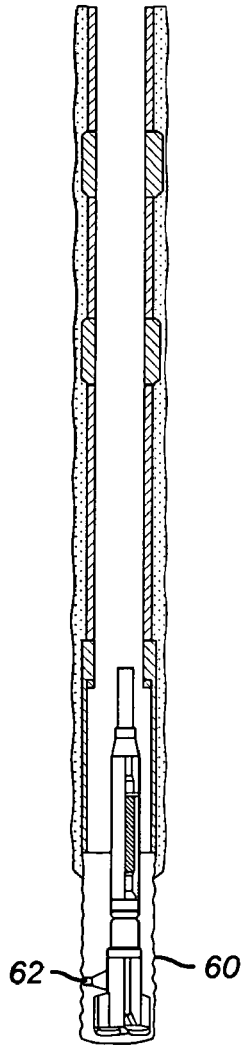
FIG. 6 is the view of FIG. 5 showing the reaming of the extension bore just drilled.
Figure 7:
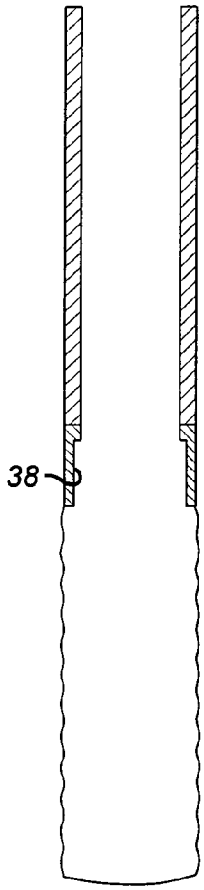
FIG. 7 is a close up view of the now exposed shoe.

FIG. 6 illustrates the enlarging of the new section of wellbore 58 to a new dimension 60 using an under-reamer or an RWD bit 62. Depending on the nature of the bit assembly 56, the wellbore 60 can be created in a single trip in the hole or in multiple trips. FIG. 7 shows the drilling of wellbore 60 complete and the drill string 54 and bit assembly 56 removed from the wellbore 60 and stored at the surface.

Figure 8:
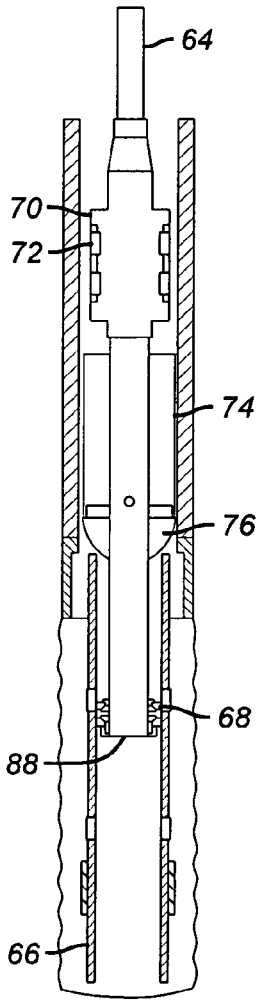
FIG. 8 shows the liner run in on a running tool and in position to be expanded.
Figure 9:
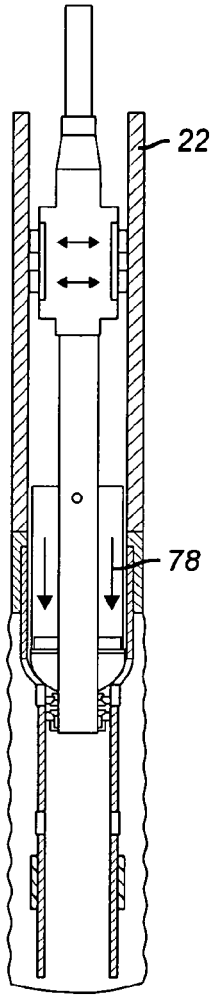
FIG. 9 is the view of FIG. 8 indicating the initial stroking of the swage, which results in release from the running tool.
Figure 10:
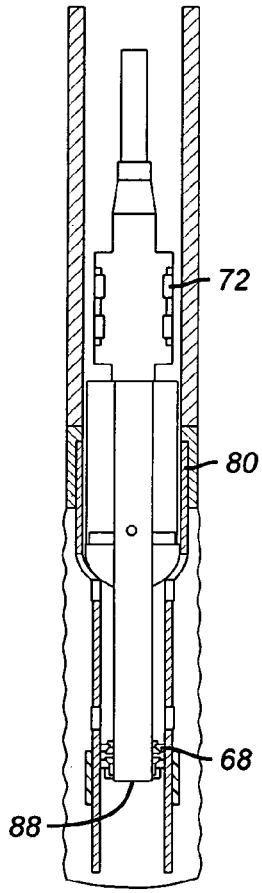
FIG. 10 is the view of FIG. 9 showing the anchor released and weight being set down to reposition for the next stroke of the swage.
Figure 11:
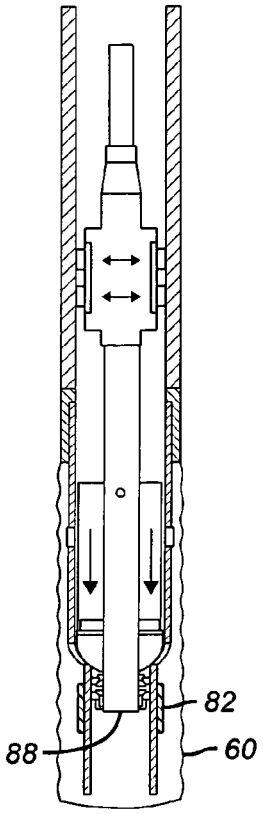
FIG. 11 is the view of FIG. 10 showing the next stroke of the swage.

FIG. 8 shows a running string 64 that supports a liner or other tubular 66 at locking dogs 68. The assembly further comprises an anchor 70 with slips 72 that are preferably pressure sensitive to extend slips 72 and allow them to retract when pressure is removed. Also in the assembly is a piston and cylinder combination 74 that drives a swage 76, in response to pressure applied to the piston and cylinder combination 74. Initially, as illustrated in FIG. 9, pressure is applied to extend the slips 72 and drive down the swage 76 as illustrated schematically by arrows 78. The upper end or expandable liner hanger 80 of the tubular 66 is expanded into recessed mounting location 38 for support from casing 22. The swage 76 is then stroked enough to suspend the tubular 66 to casing 22. As illustrated in FIG. 10, when weight is set down at the surface, after internal pressure is removed, the slips 72 have been released and the piston and cylinder combination 74 is re-cocked for another stroke for swage 76. The dogs 68 become undermined and release their grip on tubular 66 as the piston and cylinder combination is re-cocked. FIG. 11 shows the subsequent stroking, further expanding the tubular 66. Optionally, one or more open hole packers 82 can be used to ultimately make sealing contact in wellbore 60 after expansion.

Figure 12:
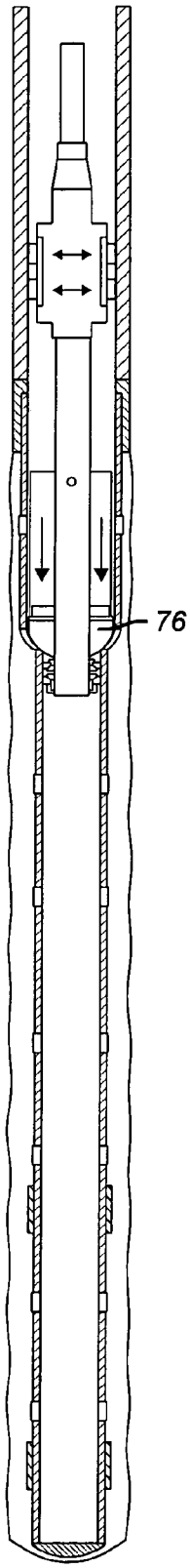
FIG. 12 is the view of FIG. 11 showing the swage advancing toward the lower end of the liner.

FIG. 12 illustrates the continuation of the movement of the swage in response to applied surface pressure to anchor 70 and piston and cylinder combination 72. Those skilled in the art will appreciate that force magnification can be incorporated into piston and cylinder combination 72 and it is possible for a greater force can be applied to swage 76 at the beginning of each stroke as compared to the balance of each stroke. These features were disclosed in co-pending U.S. application Ser. No. 60/265,061 whose filing date is Feb. 11, 2002 and whose contents are fully incorporated herein as if fully set forth. However, other techniques can be used for swaging or even to secure the tubular 66 to long recess 38 or another location initially covered by a sleeve such as 20 during cementing of the casing 22, without departing from the invention.

Figure 13:
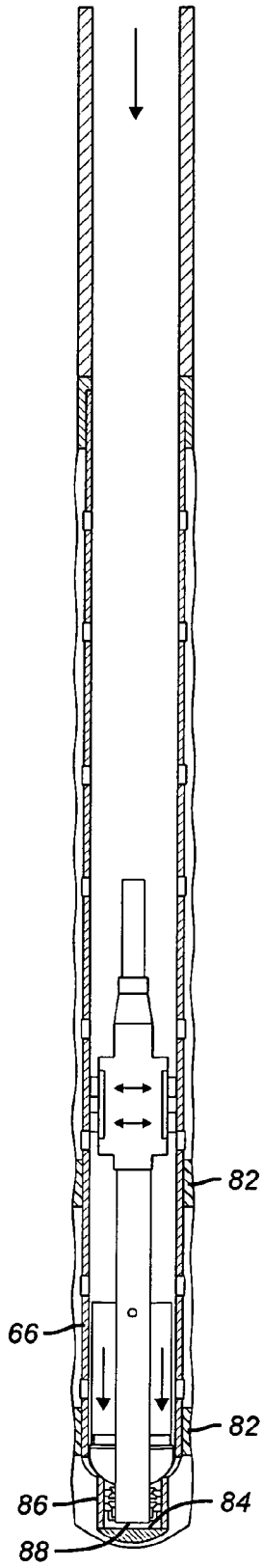
FIG. 13 is the view of FIG. 12 with the swage now engaging the running shoe of the liner at its lower end.
Figure 14:
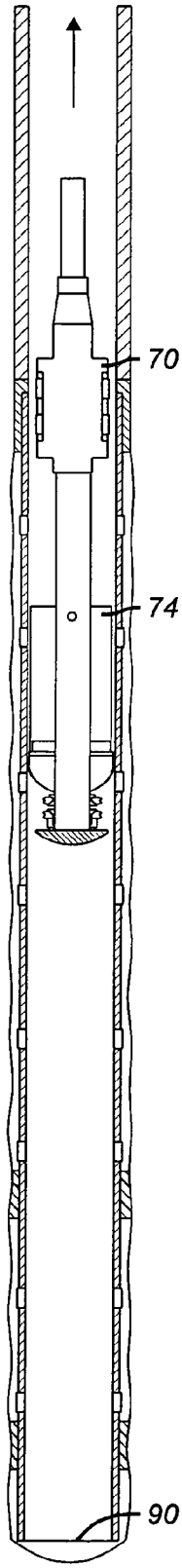
FIG. 14 is the view of FIG. 13 with the liner fully expanded and the swage being removed with the running shoe by withdrawing the running tool from the fully expanded liner.

Eventually in FIG. 13, the running string 64 expands the open hole packers 82 into sealing contact with the wellbore 60 as it approaches the run in shoe 84 mounted near the lower end 86 of tubular 66. A grasping mechanism 88 is shown schematically at the lower end of the expansion string 64. Contact is made and the run in shoe 84 is released and grabbed by mechanism 88. Swage 76 expands lower end 86 of tubular 66 enough so that the run in shoe can be retrieved through it. When the string 64 is removed from the wellbore 60 and to the surface, it takes with it the anchor 70, the piston and cylinder combination 74 and the run in shoe 84, leaving a large opening 90 in the lower end of tubular 66, as shown in FIG. 14. Those skilled in the art will appreciate that the run in shoe 84 facilitates insertion of the tubular 66 by presenting a guide nose as the tubular is initially advanced into position, as shown in FIG. 8. Optionally, it has a valve in it to check upward flow and allow downward circulation to facilitate insertion of the tubular 66. Removal of the run in shoe 84 as described above presents a large opening in the lower end of the tubular 66 to facilitate subsequent drilling operations or other completion techniques.

FIGS. 16-19 show the grasping mechanism 88 in greater detail. It has a top sub 100 connected at thread 102 below dogs 68. Top sub 100 is connected to mandrel 104 at thread 106. The run in shoe 84 is attached to tubular 66 by virtue of ring 108 held against rotation by pin 110, which extends from shoe 84. Threads 112 on ring 108 engage threads 114 on tubular 66. Ring 116 holds ring 112 in position on shoe 84. Shoe 84 has a groove 118 and a stop surface 120. Top sub 100 has a surface 122 that lands on surface 120 as the grasping mechanism 88 advances with the swage 76. When surface 122 hits surface 120 the tubular 66 has not yet been expanded. Mandrel 104 has a series of gripping collets 124 that land in groove 118 when surfaces 120 and 122 contact. When this happens, as shown in FIG. 16*a* the collets are aligned with recess 126 on mandrel 104 so that they can enter recess 118 in shoe 84. Mandrel 104 has a ring 128 held on by shear pins 130. When a downward force is applied to shoe 84 through the contact between surfaces 120 and 122, threads 112 and 114 shear out and the shoe 84 drops down and is captured on ring 128. At this point, shown in FIG. 17*a*, surface 132 on mandrel 104 supports collets 124 in groove 118. The shoe 84 is now captured to the mandrel 104. As the mandrel 104 moves down in tandem with the swage 76, the tubular 66 is expanded to bottom. Thereafter, the swage 76 and the grasping mechanism 88 and the attached shoe 84 can all be removed to the surface, as shown in FIG. 18*a*. If, for any reason the shoe 84 fails to release from the tubular 66 or gets stuck on the way out to the surface, a pull on the string 64 shears out pins 130, allowing the collets 124 to become unsupported as surface 134 is presented opposite recess 118 as shown in FIG. 19*a*. Those skilled in the art will appreciate that other devices can be used to snare the shoe 84 as the swage 76 advances. The ability to remove shoe 84 is advantageous as it removes the need to mill it out and further reduces the risk of the shoe 84 simply turning in response to a milling effort, once it is no longer held against rotation by the now expanded tubular 66.

Those skilled in the art will now appreciate the advantages of the above described aspects of the present invention. The sleeve 20 shields a subsequent mounting location for the tubular 66 on casing 22 from contamination with the cement 48 used in the installation of casing 22. Thus regardless of the method of sealed attachment between the tubular 66 and the casing 22, there is a greater assurance that the proper sealing support will be obtained without concern that cement may have fouled the mounting location. The assembly including the sleeve 20 is compliant to changes in hydrostatic pressure resulting from advancement of the casing 22 downhole. At the conclusion of expansion or other technique to secure tubular 66 to casing 22, the lower end of the tubular 66 is left open as the run in shoe 84 is retrieved.

In certain jurisdictions or with certain operators, just trying to seal around the expanded liner 66 with external packers 82 is not adequate and there is a desire to meet local regulations and provide a monobore completion with the ability to cement the expanded liner. The preferred embodiment of this invention allows such cementing to occur and the expansion and cementing process for the liner to occur in either one or two trip. Comparing the casing shoe of FIG. 15 with that of FIG. 20 it can be seen that they are the same but the version of FIG. 20 has an additional feature of a sliding sleeve valve 200 illustrated in the closed position in FIG. 20. The recessed mounting location 202 is covered by a barrier sleeve 204 whose position is maintained with one or more centralizers 206. An incompressible filler material or fluid 208 initially occupies the volume behind the barrier sleeve 204 and inside the recessed mounting location 202, the volume between outer sleeve 210 and recess sleeve 209, and the volume above guide nose 207 and between outer sleeve 210 and barrier sleeve 204. This continuous volume containing filler material or fluid 208 will be run in without applied pressure. As the shoe is run in the hole the hydrostatic pressure inside of the barrier sleeve 204, below the guide nose 207, and outside of the outer sleeve 210 will increase as collapse pressure on the items defining the volume. Burst disks 203 can be included in the guide nose 207 to allow communication between the volume containing the filler material or fluid 208 and the wellbore the shoe is being run in after a certain differential pressure is reached. This communication equalizes the pressure removing the collapse forces. During equalization wellbore fluid can enter the filler material or fluid volume and coexist with the filler material or volume 208. For run in the sliding sleeve valve 200 is preferably closed rather than the open position shown in FIG. 20 but either position can be used because the space occupied by filler material 208 is isolated so no flow can occur though while the casing attached at connection 212 is being cemented. The cement should not enter through the burst disks 203 as the volume is equalized in pressure and captured from flow. After the casing is cemented, a bit is inserted to drill out the protective assembly of the sleeve 204, centralizers 206, and parts of guide nose 207, as depicted in FIG. 21A. The filler material or fluid 208 is removed to the surface with circulation. The nose and the wellbore below it are then under reamed and the condition depicted in FIG. 21B is achieved. The drilling and under reaming is continued to extend the wellbore to accept the next section of tubular 218 In FIG. 21B sliding sleeve valve 200 is exposed as is recessed mounting location 202. Port 214 is closed and arrow 216 indicates no flow through it is possible. FIG. 22 shows the next section of tubular 218 in position and expanded into recessed mounting location 202 and beyond. As shown in FIG. 23, the assembly to do this expansion can include a combination of an anchor and stroker shown schematically as 220 that is connected to a swage 222 that can be of any number of different designs. As shown in FIG. 20, sliding sleeve valve 200 has a groove 224 that is preferably engaged at before expansion of the top of the expanded liner or expandable liner hanger by a collet assembly located on the stroker tool 220 that operates bidirectionally so that on the trip down with the liner 218, the stroker 220 the collet can provide a confirmation indication of overpull or set down weight that the liner is in the proper location for expansion of its top inside of the recessed mounting location 202. Tubular string 218 preferably has no external packers to seal the annulus 228 that extends around it. As shown in FIG. 24, it is possible for a guide nose 230 to be run on the bottom of the expandable liner and retrieved after expansion by a retrieval tool 226 at the bottom of the expansion string.

FIGS. 25-29 illustrate a $2^{nd}$ trip method of cementing the expanded liner. A cement retainer 234 is run in on a work string 236 below a shifting tool 232. First, the cement retainer 234 is to be set at the bottom of liner 218. At this point, any pressure tests can be performed to confirm that the cement retainer 234 is set properly as valve 200 is closed. Next as shown in FIG. 26, the running tool 235 for the cement retainer 234 is released and the work string 236 is tripped up hole. As the shifting tool 232 passes through the valve a similar collet assembly engages the groove 224. With this indication weight is set down and the drill string is turned to the right. Spring loaded dogs on the shifting tool 232 engage slots in the sliding sleeve valve 200 causing the sliding sleeve valve 200 to unscrew down opening it. Once the sliding sleeve valve 200 has been opened the work string 236 is tripped down hole reengaging the cement retainer running tool 235 into the cement retainer 234. As shown in FIG. 27, cement 237 is delivered through the work string 236, the shifting tool 232, the cement retainer running tool 235, and the cement retainer 234 and into the annulus 228 around the tubular string 218. Wellbore fluids 239 displaced by the pumped cement from annulus 228 go through sliding sleeve valve 200. In FIG. 28, the shifting tool 232 is located in the sliding sleeve valve 200 and forces the sliding sleeve 200 shut on the way out trapping the cement 237 in the annulus 228. FIG. 29 shows a separate trip in which the cement retainer 234 is milled out by a drill bit 244 before continuing on to drill the next hole section.

Yet another option is for the sliding sleeve valve 200 to be located in the top of the expanded liner string 218, just below the mounted section 231. This arrangement is shown in FIG. 30. This sliding sleeve valve 200 would be expanded along with the liner string 218 which it is part of to allow for at least as large a drift as the parent casing above it. Once expanded it would be operated as mentioned above and all cementing methods discussed in this application could be applied.

A method of running the expandable liner string 218, mounting the upper section of the liner string 218 to the recessed mounting location 202 via expansion, continuing on to expand the entire liner string 218, setting a cement retainer 234 in the bottom of the expanded liner string 218, opening a sliding sleeve valve 200 for the return of displaced wellbore fluids 239 from the annulus 228, pumping cement 237 in to the annulus, and closing the sliding sleeve valve 200 in one trip is illustrated in FIGS. 31-35. The primary difference between this method and that detailed above and in FIGS. 25-29 is that the cement retainer 234 is run in on the same trip as the liner 218 and expansion tools 220. FIG. 31 illustrates a liner 218 that has been delivered and mounted in the recessed mounting location 202 with the guide shoe 230 and the cement retainer 234 already in place as a combined device 246. As soon as the expandable liner 218 is mounted and adequate length has been expanded the sliding sleeve valve 200 can be opened as discussed above by shifting tool 232. The expansion tool 220 then returns to expanding the liner string 218. When the expansion tool 220 tags into the device 246, as shown in FIG. 32, cement 237 can be pumped from the surface through the expansion string 236 that extends to the surface. As previously described, the displaced wellbore fluid 239 from cementing go through now open sliding sleeve 200 and to the surface through annulus 240. FIG. 33 shows the cement 237 pumped into the annulus 228. FIG. 34 shows the expansion string 236 removed which results in the closure of sliding sleeve valve 200. The device 246 has been left in the borehole for a subsequent trip with the mill or bit 244, as shown in FIG. 35.

FIGS. 36 and 37 illustrate alternative ways to deliver a cementing shoe 268 to the lower end of a liner 270. In FIG. 36, the shoe 268 is delivered with the liner 270 and sits on or near its bottom during the expansion with the swage 272. Eventually, a gripping device 274 engages the shoe 268 to allow it to pass well fluids in the case of cement being delivered into the annulus 276. After a pre-measured amount of cement is delivered the gripping device is raised to stop the cement in the annulus 276 from coming into the liner 270. This technique is illustrated in FIGS. 38-40. In FIG. 38 arrows 278 indicate displaced well fluids from pumping cement represented by arrow 280 through ports 262. The cement is delivered down the string 282 and with the help of a diverter device known in the art allows the cement 280 to go down the annulus 270. After a pre-measured quantity of cement has been delivered to the annulus 270 the swage 272 is picked up closing the passages in the shoe 268, as shown in FIG. 39. The shoe 268 is later drilled or milled as shown with a bit or mill 286. The hole may then be drilled deeper and expanded in diameter with under-reamer 288. While introducing cement at the top of the liner has been described those skilled in the art will appreciate that cement can be pumped down through the shoe 268 and well fluid displaced out openings such as 258 or 262, as an alternative technique for cementing.

FIG. 41 shows the expandable tubular or liner 300 delivering a cement isolation device 302 located near the lower end and inside the liner 300. FIG. 42 is the same except the cement isolation device is extending beyond the lower end of the liner 300. In FIG. 43 the liner 300 is expanded by the swage assembly 304 and the expansion has progressed to near the end of the liner. In FIG. 44, the cement isolation device is captured as the swage assembly 304 finishes the expansion out through the end of the liner 300. In FIG. 45 the swage assembly 304 is raised up positioning the cement isolation device 302 in sealing contact with the liner 300. In FIG. 46 the cement 306 is pumped through the string 308 and the swage assembly 304 and into the annulus 310. After cement delivery, the string and swage assembly 304 is removed and a mill 312 is run into the liner 300 to mill the cement isolation device 302 out. The cement isolation assembly can employ an actuable seal 314 that can be energized by pressure or mechanically or in other ways to seal against the inner wall of the liner 300 when brought back inside it. The ability to take the device 302 right through the liner 300 allows the swage assembly 304 to go clean through to the end of the liner 300 in expanding it. The actuable seal 314 then allows the device 302 to seal against the now enlarged liner 300. The device 302 can be made of soft metals or non-metallic materials to shorten milling time shown in FIG. 47. The advantage to delivering the device 302 below the liner 300 is that it can be larger so that after expansion of the liner 300 and the device 302 needs to be brought back into sealing contact in the liner, the gap to bridge is that much smaller. The device 302 can be configured to allow fluid to pass through in one or both directions during run in to facilitate insertion. While the tubular 300 is referred to as a liner other structures involving openings such as screens or slotted liners or casing can also be used in the described method. FIGS. 41-47 illustrate a one trip deliver, expand and cement system.

The foregoing disclosure and description of the invention are illustrative and explanatory thereof, and various changes in the size, shape and materials, as well as in the details of the illustrated construction, may be made without departing from the spirit of the invention.

We claim:

1. A completion method, comprising:

running in a tubular to be expanded into a wellbore with a run in shoe assembly adjacent a lower end thereof for attachment to an existing tubular;

initially expanding a portion of the tubular with a swage assembly;

engaging the run in shoe assembly with said swage assembly after said initially expanding;

finishing expansion to said lower end by advancing the now engaged run in shoe assembly beyond said lower end;

returning said shoe assembly to the now expanded lower end for cementing therethrough;

providing a valve in the wall of the tubular to be expanded;

expanding said valve when the tubular is expanded; and removing the run in shoe assembly through the now expanded tubular.

2. A completion method, comprising:

running in a tubular to be expanded into a wellbore with a run in shoe adjacent a lower end thereof for attachment to an existing tubular;

expanding the tubular with a swage assembly;

engaging the run in shoe with said swage assembly;

finishing expansion to said lower end by advancing the now engaged run in shoe beyond said lower end;

providing a valve in the wall of the tubular to be expanded;

expanding said valve when the tubular is expanded;

operating said valve after it is expanded; and removing the run in shoe through the now expanded tubular.

3. The method of claim 2, comprising: operating said valve with said swage assembly.

4. A completion method, comprising:

running in a tubular to be expanded into a wellbore with a run in shoe adjacent a lower end thereof for attachment to an existing tubular;

expanding the tubular with a swage assembly;

engaging the run in shoe with said swage assembly; and removing the run in shoe through the now expanded tubular;

providing a valve in said existing tubular; and operating said valve with said swage assembly.

5. The method of claim 4, comprising:

running in a cementing shoe on a string into the expanded tubular;

setting said cementing shoe in said expanded tubular;

operating said valve in said existing tubular from said string; and cementing through said string and cementing shoe.

6. The method of claim 5, comprising:

using said string to set said cementing shoe;

providing a shifting tool on said string; releasing from said cementing shoe, when set, to shift said valve in said existing tubular;

tagging into said set shoe with said string after operating said valve.

* * * * *